US011014220B2

(12) United States Patent
Sunderland

(10) Patent No.: US 11,014,220 B2
(45) Date of Patent: May 25, 2021

(54) SHUTTER ADJUSTMENT DEVICE

(71) Applicant: Don R. Sunderland, Fargo, ND (US)

(72) Inventor: Don R. Sunderland, Fargo, ND (US)

( * ) Notice: Subject to any disclaimer, the term of this patent is extended or adjusted under 35 U.S.C. 154(b) by 306 days.

(21) Appl. No.: 16/285,828

(22) Filed: Feb. 26, 2019

(65) Prior Publication Data

US 2020/0269395 A1 Aug. 27, 2020

(51) Int. Cl.

| | |
|---|---|
| ***B25B 13/50*** | (2006.01) |
| ***E06B 9/78*** | (2006.01) |
| *B25B 21/00* | (2006.01) |
| *E06B 9/00* | (2006.01) |

(52) U.S. Cl.
CPC ..... *B25B 13/5091* (2013.01); *E06B 9/78* (2013.01); *B25B 21/002* (2013.01); *E06B 2009/005* (2013.01)

(58) Field of Classification Search
CPC . E06B 9/78; E06B 2009/005; B25B 13/5091; B25B 21/002
See application file for complete search history.

(56) References Cited

U.S. PATENT DOCUMENTS 3,010,346 A * 11/1961 Kulp ..... B25B 13/5091 81/124.2
3,411,555 A * 11/1968 Herpich ..... B25B 15/005 81/460
4,357,845 A * 11/1982 Cornia ..... B25B 23/12 81/124.2
4,984,489 A * 1/1991 Krauthamer ..... B25B 13/48 81/121.1
5,615,587 A * 4/1997 Foerster, Jr. ..... B25B 13/06 81/124.2
6,010,154 A * 1/2000 Payne ..... B25B 13/48 279/904
6,477,924 B1 11/2002 Talbot
6,715,384 B1 * 4/2004 Kozak ..... B25B 13/06 81/124.2
6,901,825 B1 6/2005 Lebron
9,879,475 B2 1/2018 Mullet
2013/0220560 A1 8/2013 Mullet
2016/0201388 A1 7/2016 Wen
2018/0171705 A1 6/2018 Marocco

* cited by examiner

*Primary Examiner* — Beth A Stephan
(74) *Attorney, Agent, or Firm* — Neustel Law Offices

(57) ABSTRACT

A shutter adjustment device for utilizing a tool such as a drill to easily and effortlessly raise or lower storm shutters. The shutter adjustment device generally includes a housing adapted to be connected between a drill and a shutter lever of a storm shutter. The housing may be connected to a drill such that the housing rotates when the drill is activated. The shutter lever may be removably engaged within a clamp assembly of the housing such that the shutter lever may be easily rotated by activating the drill. In this manner, the shutter may be easily raised or lowered with little effort using the drill.

19 Claims, 14 Drawing Sheets

SHUTTER ADJUSTMENT DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a shutter adjustment device for utilizing a tool such as a drill to easily and effortlessly raise or lower storm shutters.

Related Art

Any discussion of the related art throughout the specification should in no way be considered as an admission that such related art is widely known or forms part of common general knowledge in the field.

Storm and hurricane shutters are in use throughout coastal communities worldwide. As hurricanes become more prevalent and increase in intensity, more homes and businesses are installing hurricane shutters to protect their wellbeing and valuables. Such hurricane shutters typically include a shutter lever which is rotated, such as by a hand crank or by hand, to raise or lower the shutters.

Many individuals are unable to raise or lower the shutters due to various conditions such as age, illness, or injury. When there are a large number of windows in a structure, it can be extremely tiring to raise or lower all of the shutters, particularly if in a hurry due to an unexpected strong storm. While hand cranks do provide some relief, they still require significant effort on some types of shutters or where there are a large number of shutters to raise or lower.

SUMMARY

An example embodiment is directed to a shutter adjustment device. The shutter adjustment device includes a housing adapted to be connected between a drill and a shutter lever of a storm shutter. The housing may be connected to a drill such that the housing rotates when the drill is activated. The shutter lever may be removably engaged within a clamp assembly of the housing such that the shutter lever may be easily rotated by activating the drill. In this manner, the shutter may be easily raised or lowered with little effort using the drill.

There has thus been outlined, rather broadly, some of the embodiments of the shutter adjustment device in order that the detailed description thereof may be better understood, and in order that the present contribution to the art may be better appreciated. There are additional embodiments of the shutter adjustment device that will be described hereinafter and that will form the subject matter of the claims appended hereto. In this respect, before explaining at least one embodiment of the shutter adjustment device in detail, it is to be understood that the shutter adjustment device is not limited in its application to the details of construction or to the arrangements of the components set forth in the following description or illustrated in the drawings. The shutter adjustment device is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 2:
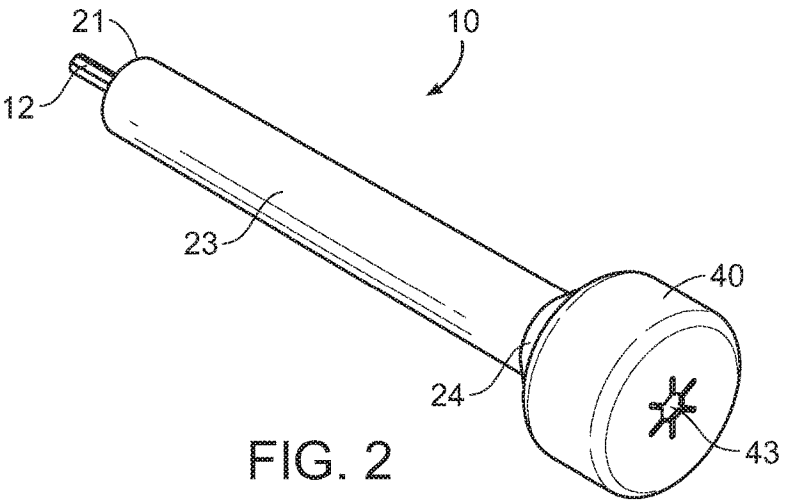
FIG. 2 is a second perspective view of a shutter adjustment device in accordance with an example embodiment.

A. Overview.

An example shutter adjustment device generally comprises a housing 20 including a first end 21 and a second end 22. The housing 20 includes a receiver opening 24 in the second end 22 of the housing 20, the receiver opening 24 providing access to a cavity 28 formed in the second end 22 of the housing 20. A clamp assembly 30 may be connected within the cavity 28 of the housing 20, with the clamp assembly 30 being adapted to removably engage with a shutter lever 16 of a shutter 15 when the shutter lever 16 is inserted within the receiver opening 26 of the housing 20. The housing is adapted to be removably connected to a drill 13 such that the housing 20 may be rotated by the drill 13 to raise or lower the shutter 15 when the shutter lever 16 is secured within the clamp assembly 30.

The housing 20 may comprise a handle portion 23 and a receiver portion 24, with the handle portion 23 being elongated and the receiver portion 24 being wider than the handle portion 23. The housing 20 may comprise a plurality of supports 29 within the cavity 28, with the clamp assembly 30 being connected to the plurality of supports 29. The clamp assembly 30 may comprise a base 31 and a plurality of grips 32 which extend from the base 31. The base 31 of the clamp assembly 30 may be secured around the plurality of supports 29 by a hose clamp 33. The grips 32 may extend through gaps between each of the plurality of supports 29, which serve as guides for the grips 32.

The clamp assembly 30 may comprise a hose clamp 33 for biasing the grips 32 into a closed position. The clamp assembly 30 may include a tightening member 38 for tightening or loosening the hose clamp 33. The housing 20 may comprise a slot 27 positioned over the tightening member 38 such that a tool 18 such as a screwdriver may be inserted through the slot 27 to adjust the tightening member 38. The housing 20 may comprise a lip 25 against which the tightening member 38 of the clamp assembly 30 is secured so as to prevent rotation of the clamp assembly 30 within the housing 20. A connector 50 may extend from the first end 21 of the housing 20 to connect to the drill 13. The connector 50 may comprise a T-shape. A cover 40 may be removably connected over the receiver opening 26 of the housing 20.

Another exemplary embodiment of a shutter adjustment device 10 may comprise a housing 20 including a first end 21 and a second end 22, wherein the housing comprises a receiver portion 24 and a handle portion 23, wherein the handle portion 23 is elongated. A receiver opening 26 may be positioned in the receiver portion 24 of the housing 20, the receiver opening 26 providing access to a cavity 28 formed in the receiver portion 24 of the housing 20.

A clamp assembly 30 may be connected within the cavity 28 of the receiver portion 24 of the housing 20, the clamp assembly 30 being adapted to removably engage with a shutter lever 16 of a shutter 15 when the shutter lever 16 is inserted within the receiver opening 26 of the housing 20. A connector 50 may extend from the first end 21 of the housing 20, the connector being adapted to removably connect a drill 13 to the housing 20 such that the housing 20 may be rotated by the drill 13, wherein the housing 20 is adapted to be rotated by the drill 13 to raise or lower the shutter 15 when the shutter lever 16 is secured within the clamp assembly 30.

The clamp assembly 30 may comprise a plurality of grips 32 which are adapted to removably engage with the shutter lever 16. The grips 32 may be biased toward a closed position. The clamp assembly 30 may comprise a hose clamp 33 connected around the grips 32 to bias the grips 32 toward the closed position. The clamp assembly 30 may comprise a base 31, wherein the grips 32 extend from the base 31. The base 31 may comprise a cord which is threaded through the grips 32. The housing 20 may comprise a plurality of supports 29 within the cavity 28 of the housing 20, wherein the base 31 of the clamp assembly 30 is connected around the plurality of supports 29.

B. Housing.

Figure 3:
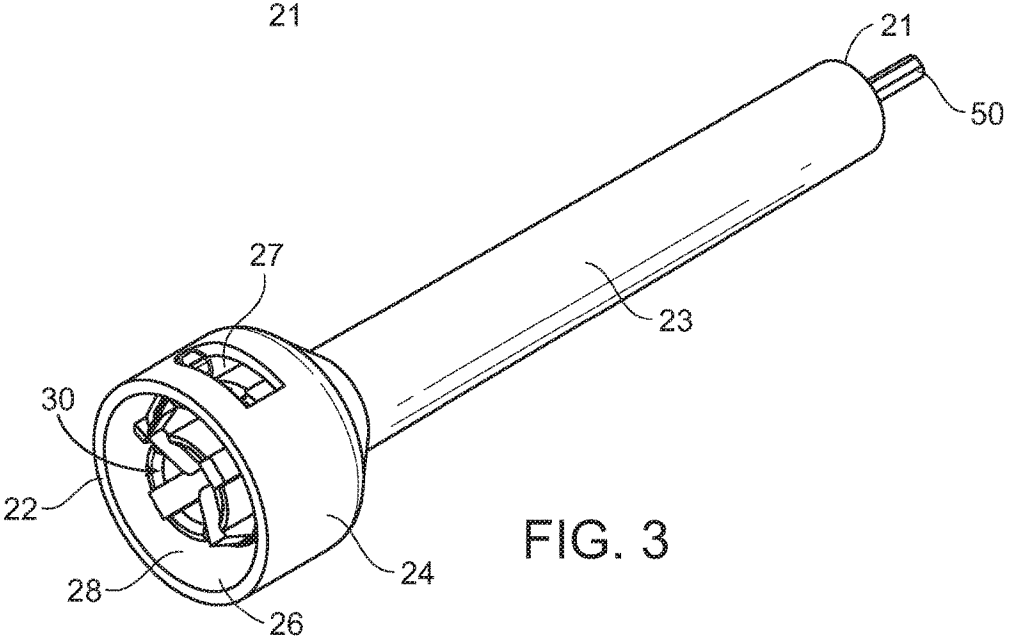
FIG. 3 is a perspective view of a shutter adjustment device with the cover removed in accordance with an example embodiment.
Figure 1:
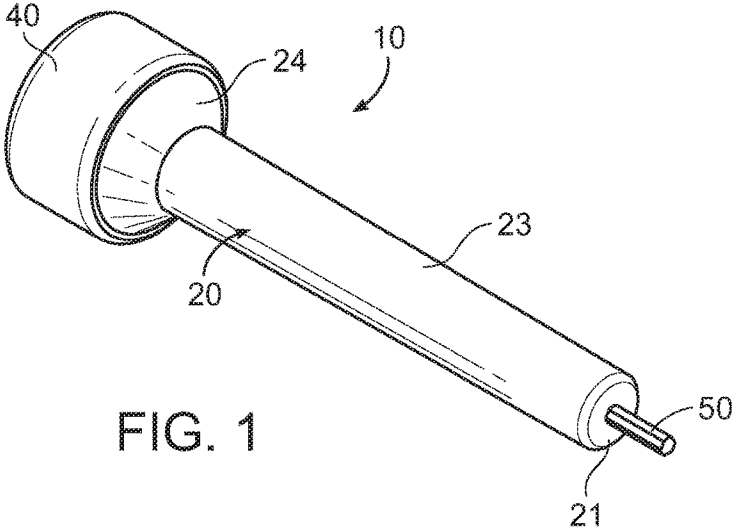
FIG. 1 is a first perspective view of a shutter adjustment device in accordance with an example embodiment.

As best shown in FIGS. 1-3, an exemplary embodiment of the shutter adjustment device 10 may comprise a housing 20 having a first end 21 and a second end 22. The shape, size, and configuration of the housing 20 may vary in different embodiments. In the exemplary embodiment shown in the figures, the housing 20 is illustrated as comprising an elongated configuration which is shaped similar to a flashlight. It should be appreciated that a wide range of shapes and sizes may be utilized for the housing 20 to accommodate different applications, such as different types of shutters 15 or drills 13.

In the exemplary embodiment shown in FIGS. 1-3, the housing 20 includes a handle portion 23 and a receiver portion 24. The handle portion 23 is elongated and may comprise a cylindrical shape as shown in the figures, or may comprise other shapes. The handle portion 23 is generally adapted to be grasped by the user when the shutter adjustment device 10 is in use. The size of the handle portion 23 may vary in different embodiments. Further, the handle portion 23 may be solid, hollow, or a combination thereof.

Figure 15:
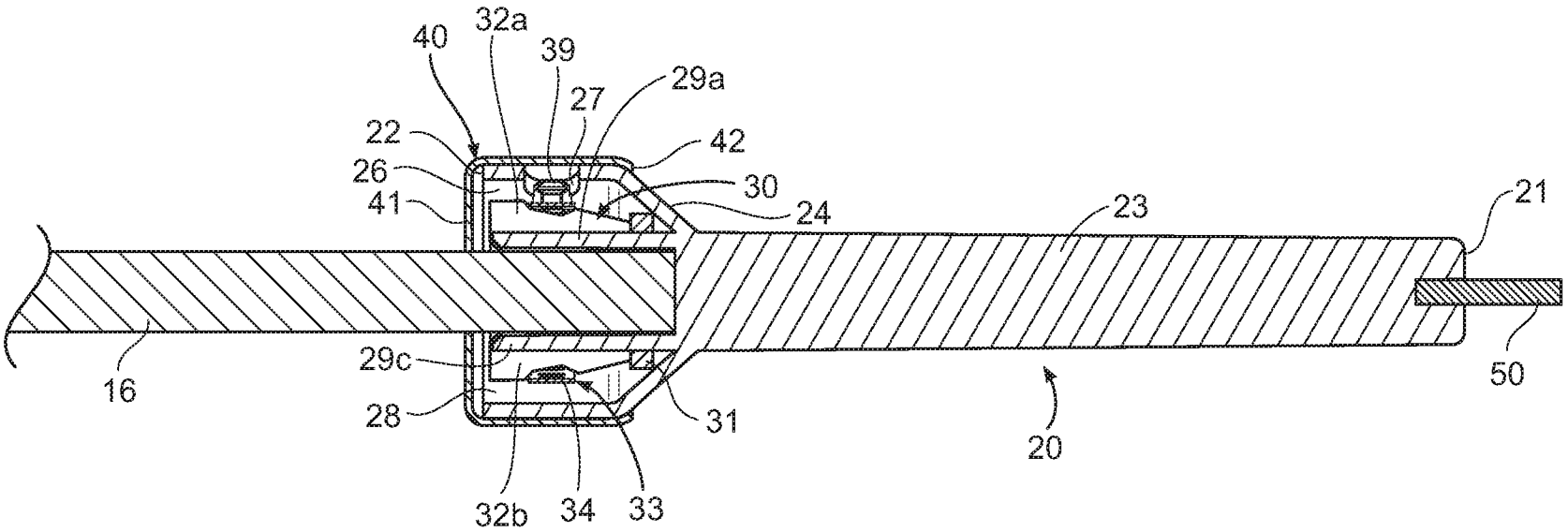
FIG. 15 is a side sectional view of a shutter adjustment device in use in accordance with an example embodiment.
Figure 23:
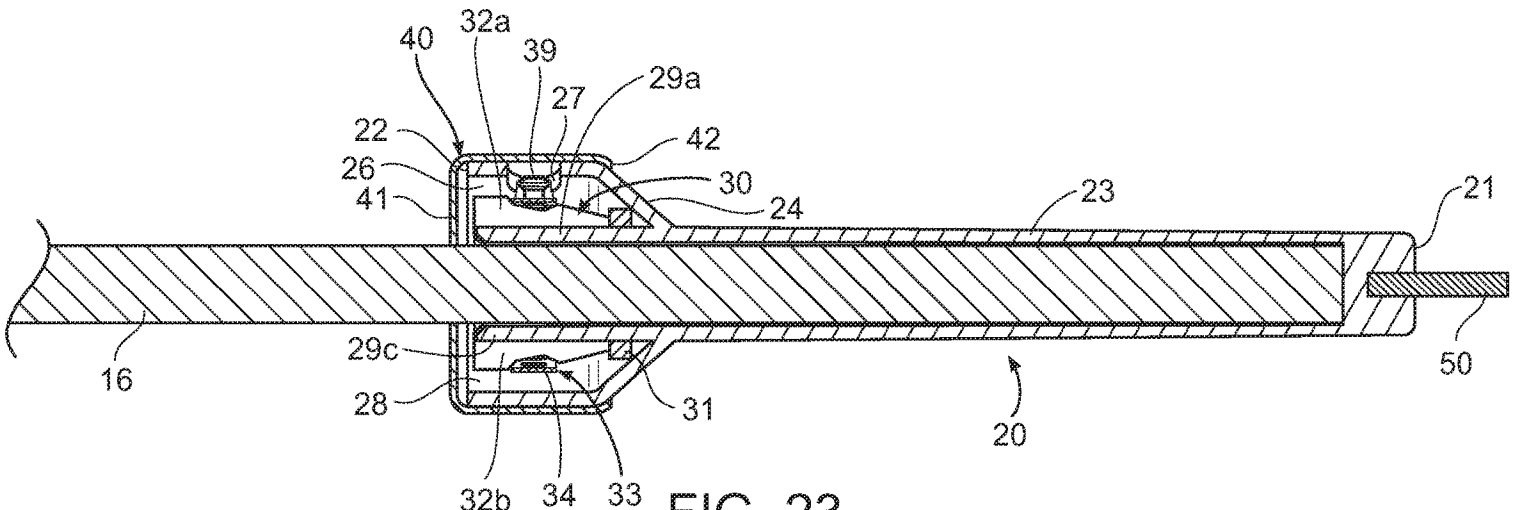
FIG. 23 is a side sectional view of a shutter adjustment device in use in accordance with an example embodiment.
Figure 24:
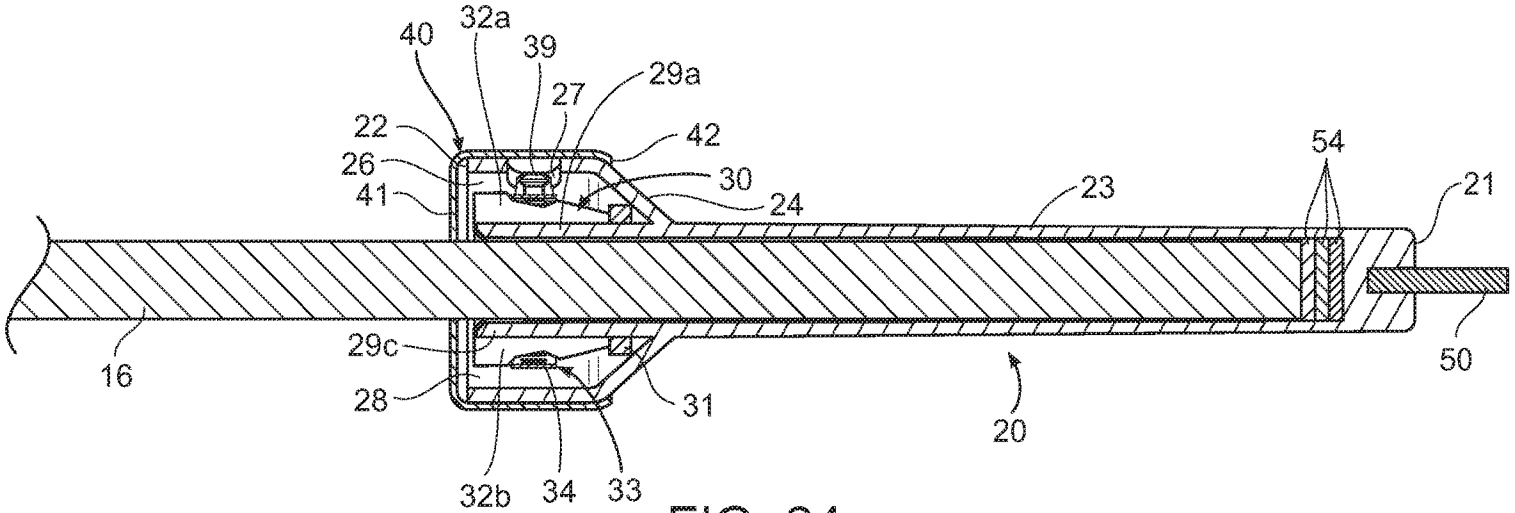
FIG. 24 is a side sectional view of a shutter adjustment device including plus in use in accordance with an example embodiment.

FIG. 15 illustrates an exemplary embodiment in which the handle portion 23 is largely solid. FIG. 23 illustrates an exemplary embodiment in which the handle portion 23 may be hollow such that the shutter lever 16 extends into the handle portion 23. As shown in FIG. 24, inserts 54 may be provided with such embodiments to adjust the length of shutter lever 16 extending into the handle portion 23. FIG. 24 illustrates an exemplary embodiment in which three inserts 54 are utilized. It should be appreciated that more or less inserts 54 may be used for different applications.

Figure 4:
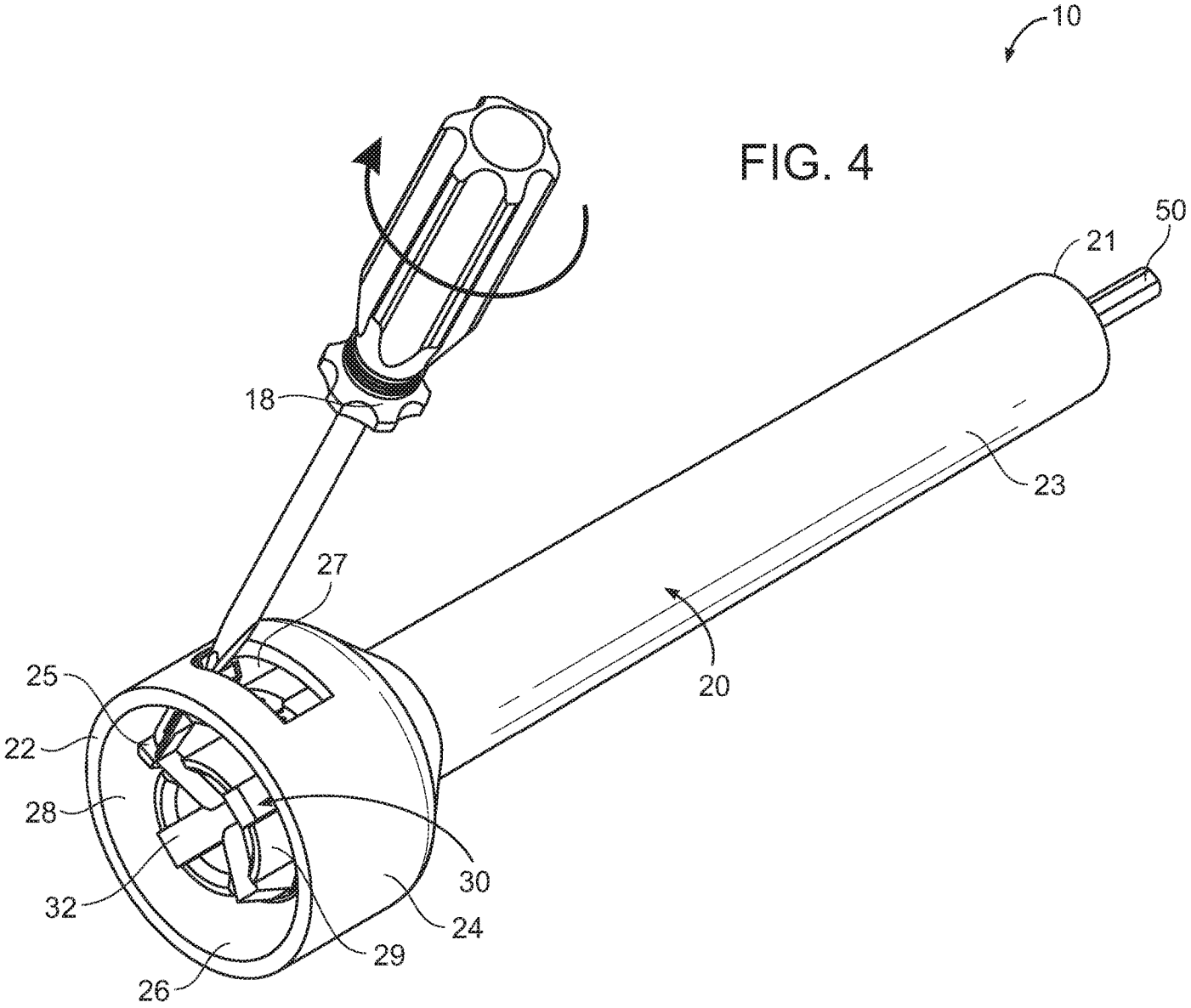
FIG. 4 is a perspective view illustrating adjustment of the clamp assembly by a screwdriver through the slot of the housing in accordance with an example embodiment.
Figure 5:
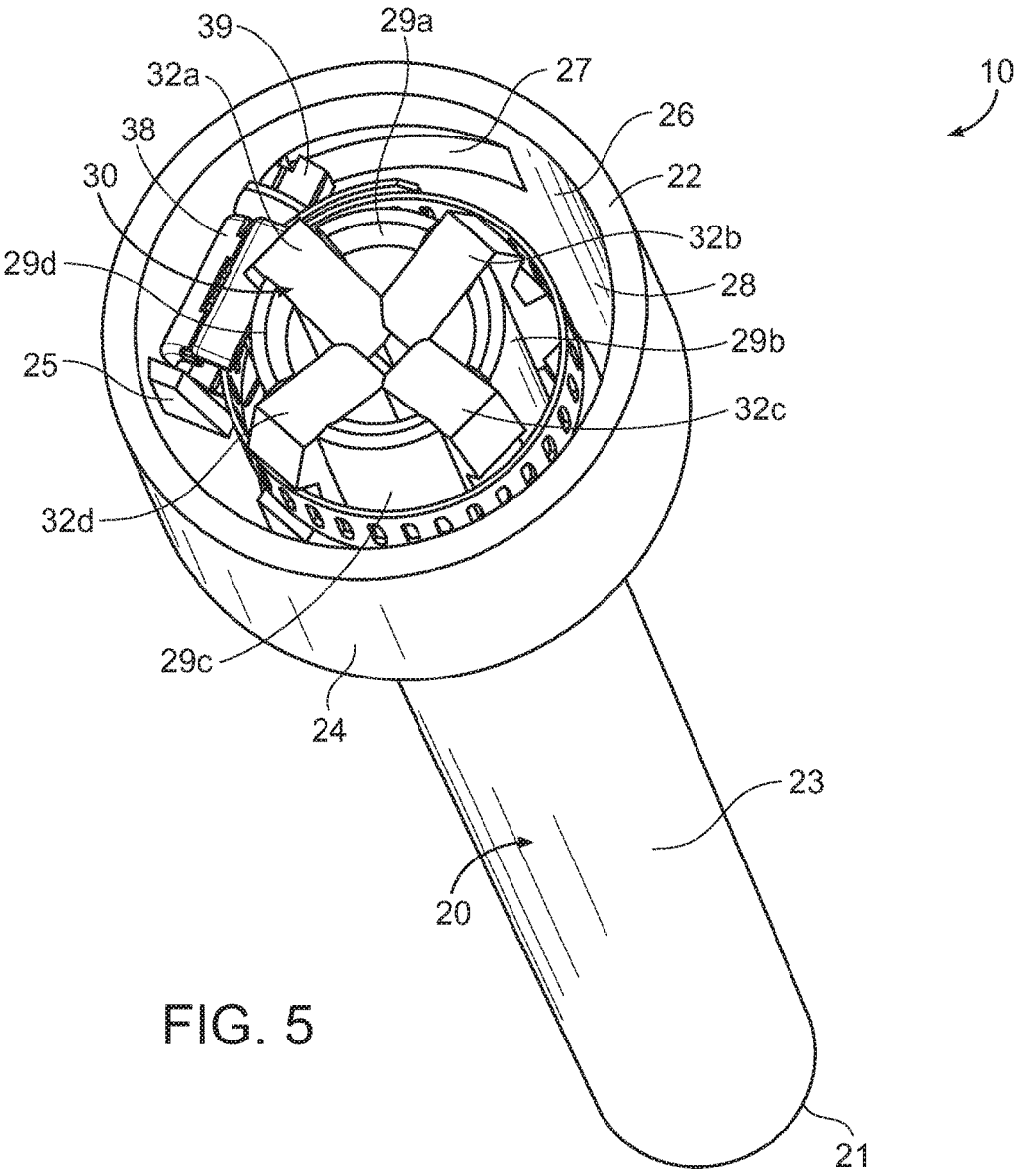
FIG. 5 is an end perspective view of a shutter adjustment device in accordance with an example embodiment.
Figure 8:
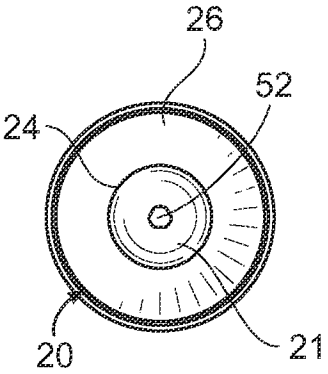
FIG. 8 is an end view of a shutter adjustment device in accordance with an example embodiment.
Figure 7:
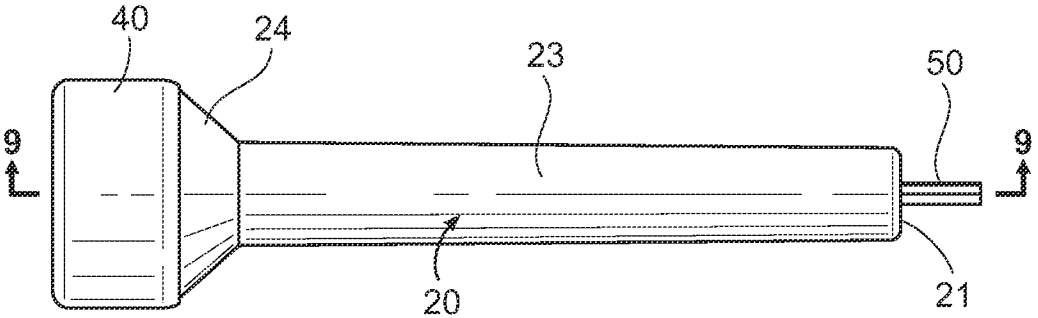
FIG. 7 is a side view of a shutter adjustment device in accordance with an example embodiment.
Figure 6:
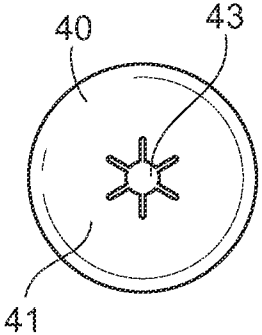
FIG. 6 is an end view of a shutter adjustment device in accordance with an example embodiment.

An exemplary receiver portion 24 is best shown in FIGS. 4 and 5. As shown, an exemplary embodiment of the receiver portion 24 may be wider than the handle portion 23, with the receiver portion 24 tapering out with respect to the handle portion 23 such as shown in FIG. 4. Although not shown, it should be appreciated that in some embodiments the receiver portion 24 may comprise the same width or circumference as the handle portion 23.

As shown in FIG. 15, the receiver portion 24 is adapted to removably receive and selectively engage with the lever 16 of the shutter 15 so that the lever 16 may be rotated by the drill 13. The receiver portion 24 may comprise a receiver opening 26 into which the shutter lever 16 is inserted for use. The shape and size of the receiver opening 26 may vary in different embodiments and should not be construed as being limited by the exemplary embodiment shown in the figures in which the receiver opening 26 is circular.

As shown in FIGS. 4 and 5, the receiver portion 24 may comprise a cavity 28 for receiving the shutter lever 16. The receiver opening 26 provides access to the cavity 28 of the receiver portion 24. The shape (such as cross-section) and size (such as depth) of the cavity 28 may vary in different embodiments to suit different types of shutter levers 16. In some embodiments, the cavity 28 may extend into the handle portion 23.

As best shown in FIG. 4, the receiver portion 24 may comprise a slot 27 along its outer circumference. The slot 27 may provide access into the cavity 28 from outside the side of the cavity 28 as shown in FIG. 4. The shape and size of the slot 27 may vary in different embodiments. The slot 27 provides access to the tightening member 38 of the clamp assembly 30 so as to adjust the grips 32 as discussed herein. FIG. 4 illustrates a tool 18 being inserted through the slot 27 to adjust the clamp assembly 30.

As best shown in FIG. 5, the receiver portion 24 may comprise a lip 25 which supports the clamp assembly 30 in place so as to prevent rotation of the clamp assembly 30 when, for example, a tool 18 such as a screwdriver is used to tighten or loosen the clamp assembly 30. The shape and size of the lip 25 may vary in different embodiments. In some embodiments, the lip 25 may be omitted entirely, with other methods being used to secure the clamp assembly 30 in place and prevent rotation. For example, the clamp assembly 30 could be secured directly to the receiver portion 24, such as by a fastener, adhesive, or the like.

The tightening member 38 of the clamp assembly 30 may rest against the lip 25 as shown in FIG. 5 such that when force is applied against the tightening member 38, such as by a tool 18, the lip 25 provides the counteracting force to prevent rotation of the clamp assembly 30 within the receiver portion 24 of the housing 20.

The lip 25 may be positioned at any location along the inner circumference of the receiver portion 24 within the cavity 28. In the exemplary embodiment shown in FIG. 5, the lip 25 is illustrated as being slightly offset but aligned with the slot 27. The tightening member 38 of the clamp assembly 30 is positioned between the lip 25 and the slot 27, with the screw 39 of the tightening member 38 being positioned within the slot 27 for ease-of-access.

Figure 10:
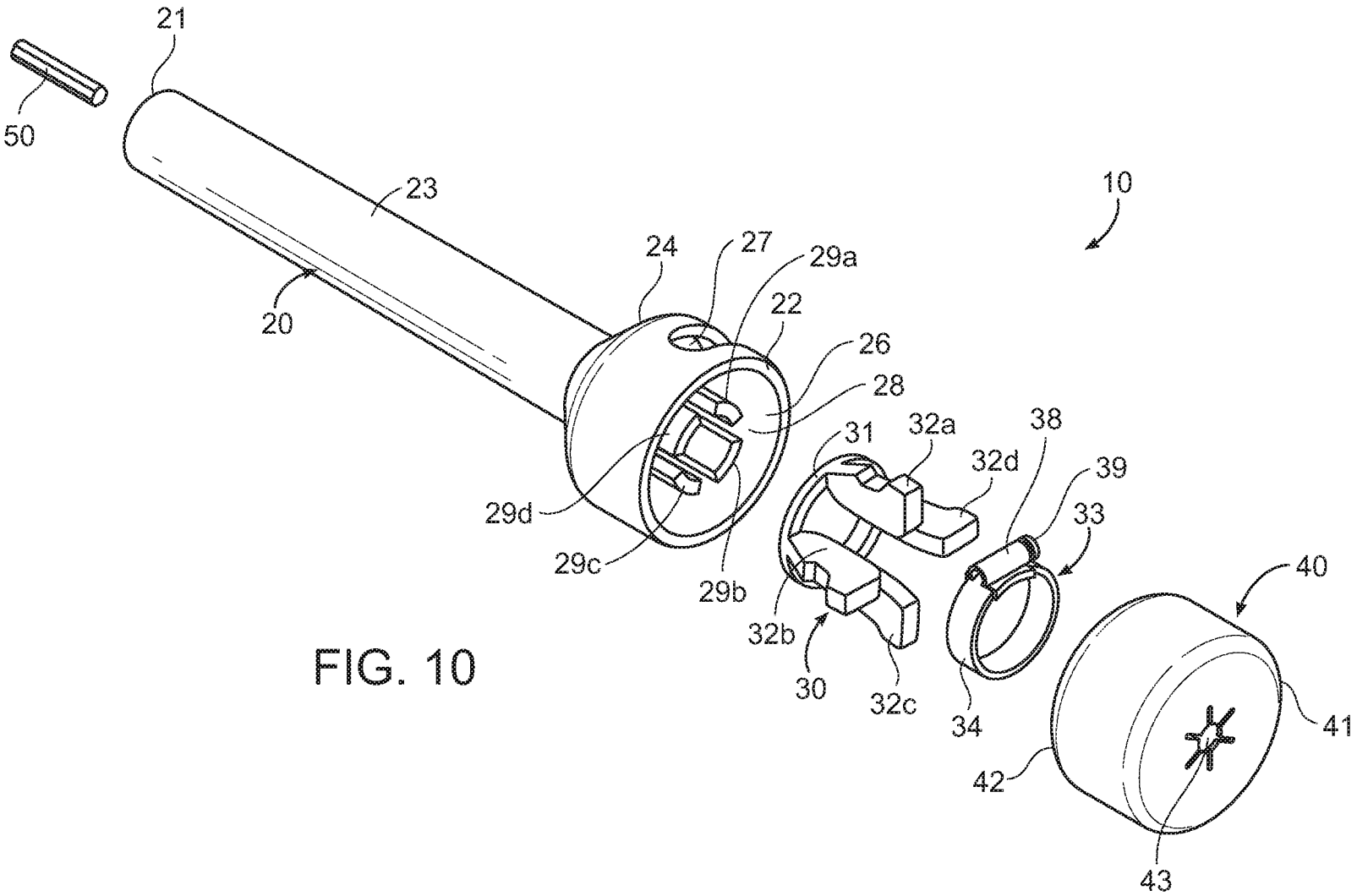
FIG. 10 is a second exploded perspective view of a shutter adjustment device in accordance with an example embodiment.

As best shown in FIG. 10, the housing 20 may comprise a plurality of supports 29 to which the clamp assembly 30 may be engaged to secure the clamp assembly 30 within the receiver portion 24. The number of supports 29 may vary in different embodiments. In the exemplary embodiment shown in the figures, a total of four supports 29*a*, 29*b*, 29*c*, 29*d* are illustrated.

The first support 29*a*, second support 29*b*, third support 29*c*, and fourth support 29*d* are illustrated as being spaced-apart with respect to each other forming an overall circular shape. It should be appreciated that other arrangements may be utilized. The base 31 of the clamp assembly 30 may engage around the supports 29*a*, 29*b*, 29*c*, 29*d*, with each of the grips 32 being positioned in a gap between a pair of the supports 29*a*, 29*b*, 29*c*, 29*d* such as shown in FIG. 5.

C. Clamp Assembly.

As shown throughout the figures, a clamp assembly 30 may be utilized to removably and selectively engage with the shutter lever 16 when the shutter lever 16 is inserted into the housing 20. The type of clamp assembly 30 utilized may vary in different embodiments so long as the shutter lever 16 may be firmly and removably secured within the housing 20 to be adjusted.

Figure 9:
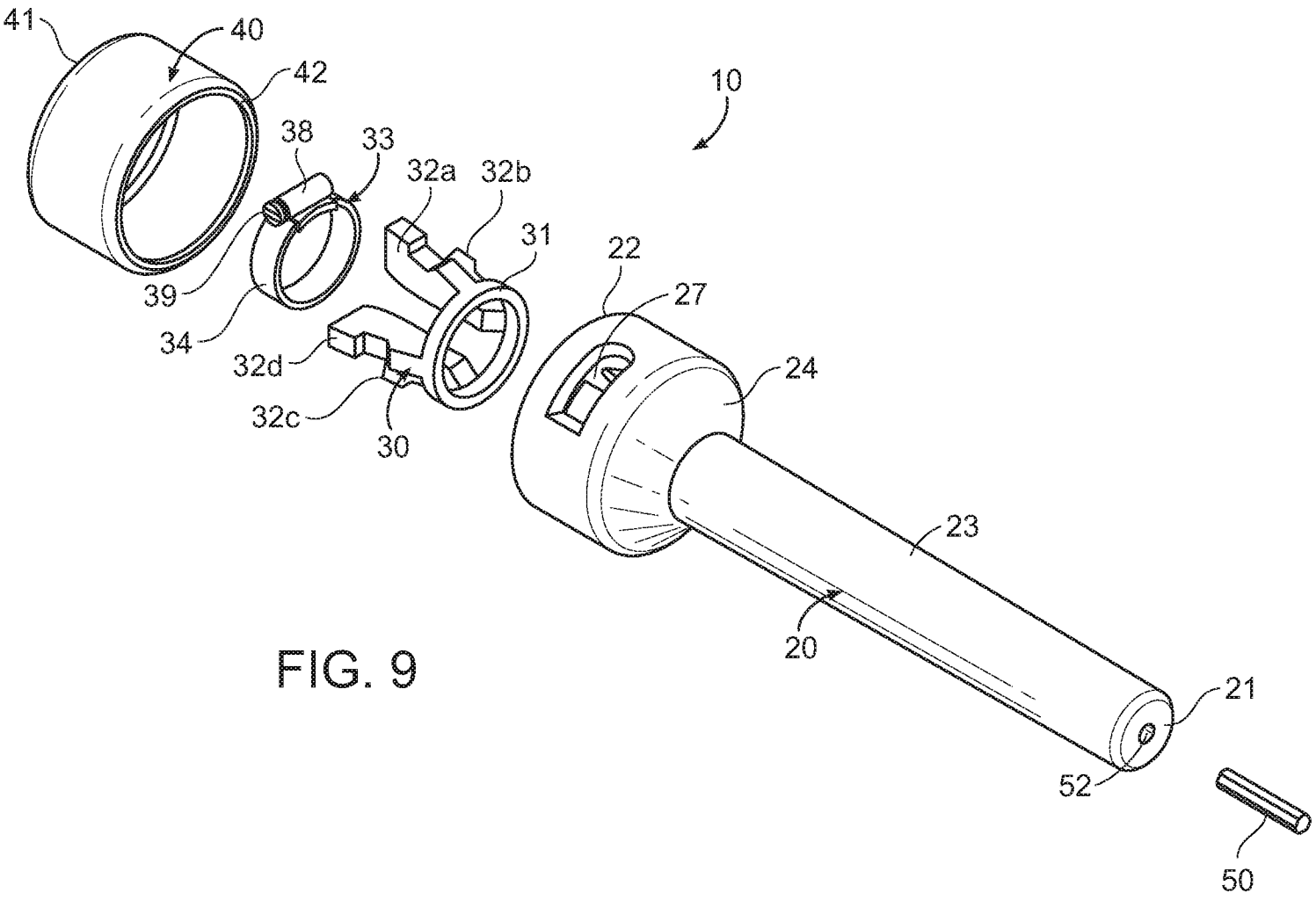
FIG. 9 is a first exploded perspective view of a shutter adjustment device in accordance with an example embodiment.
Figure 11:
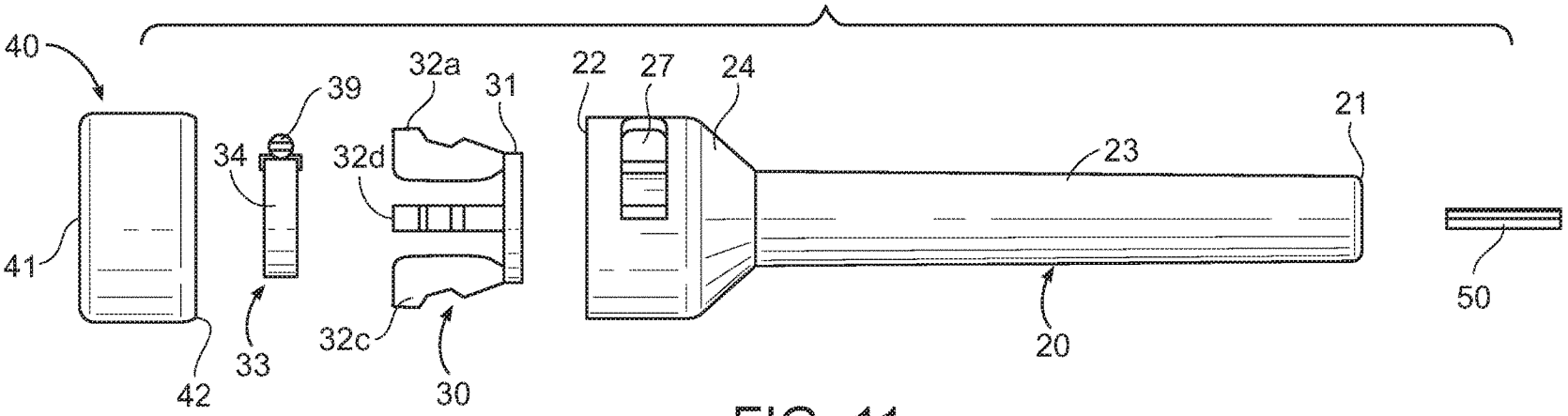
FIG. 11 is a side exploded view of a shutter adjustment device in accordance with an example embodiment.
Figure 16:
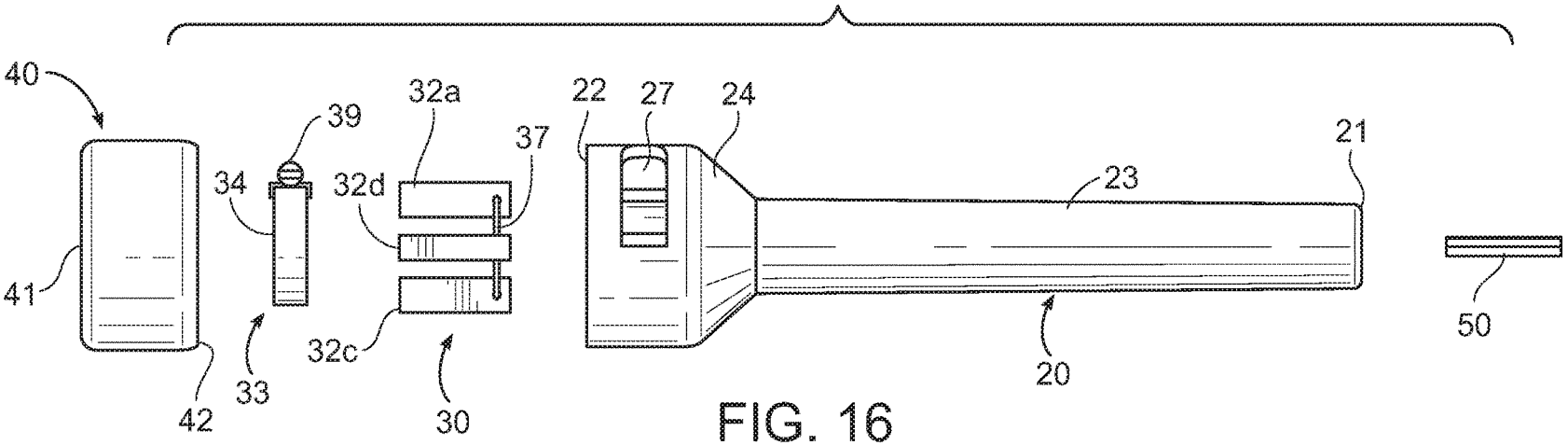
FIG. 16 is a side exploded view of a shutter adjustment device utilizing an alternate clamp assembly in accordance with an example embodiment.
Figure 17:
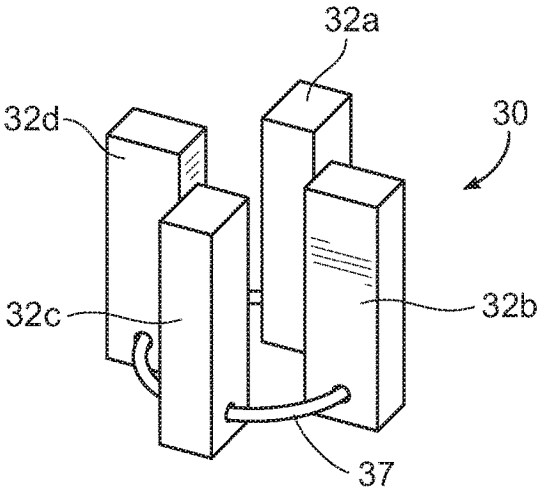
FIG. 17 is a perspective view of an alternate clamp assembly in accordance with an example embodiment.
Figure 18:
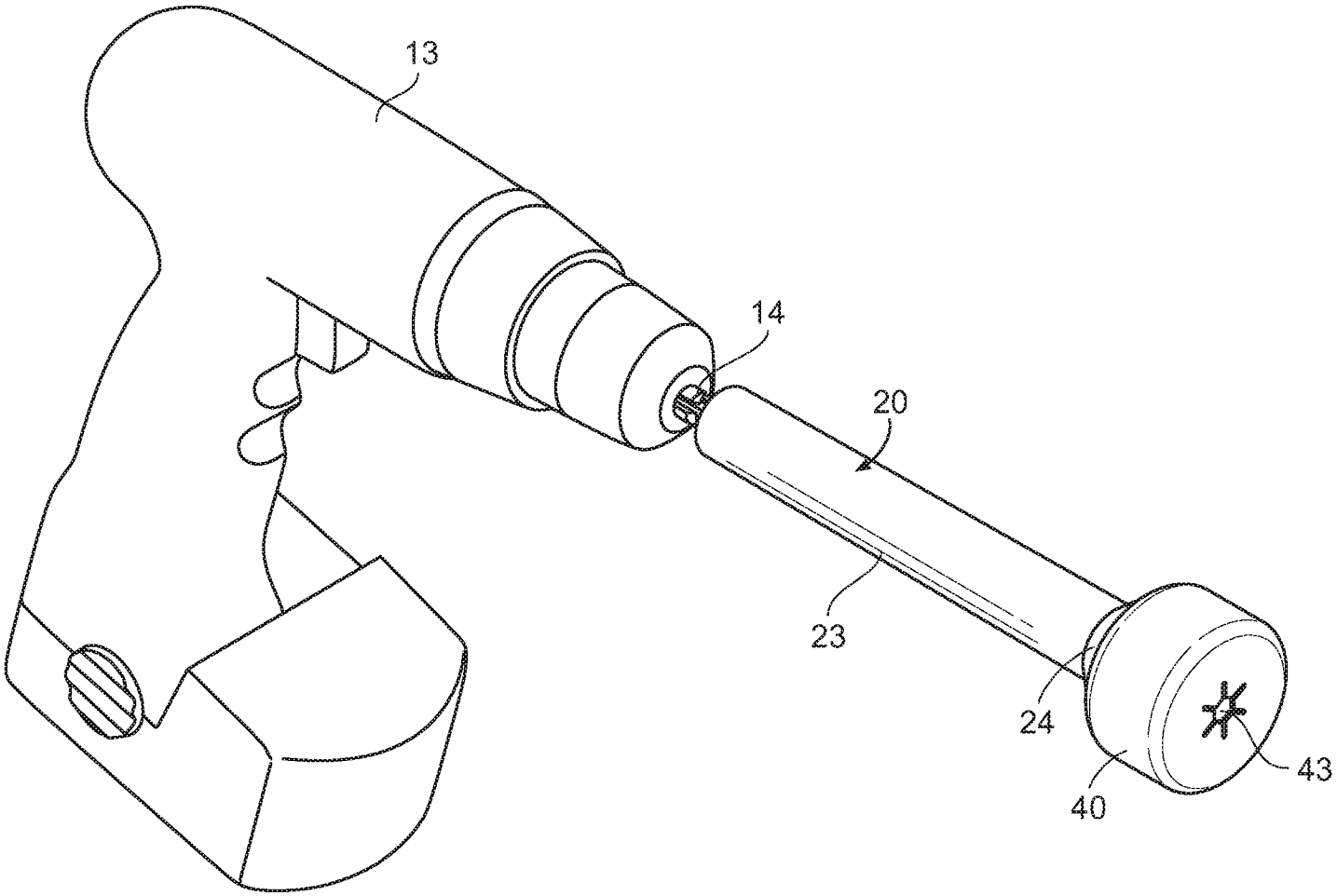
FIG. 18 is a perspective view of a shutter adjustment device connected to a drill in accordance with an example embodiment.
Figure 20:
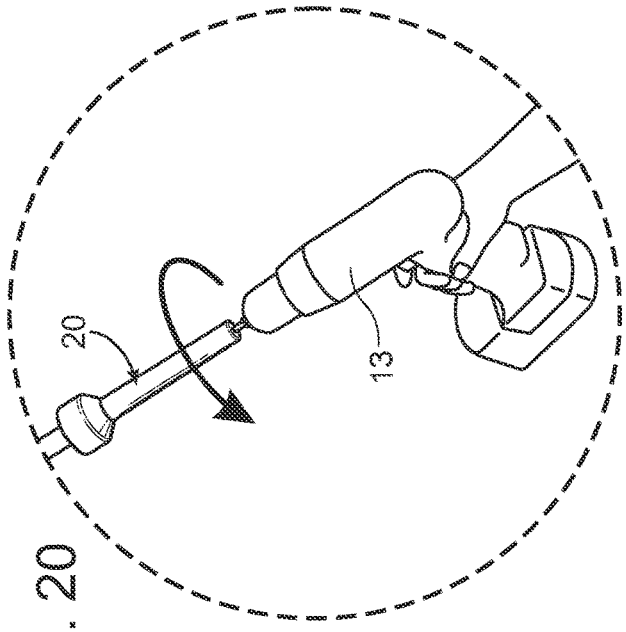
FIG. 20 is a close-up view from FIG. 19 of a shutter adjustment device in use in accordance with an example embodiment.
Figure 19:
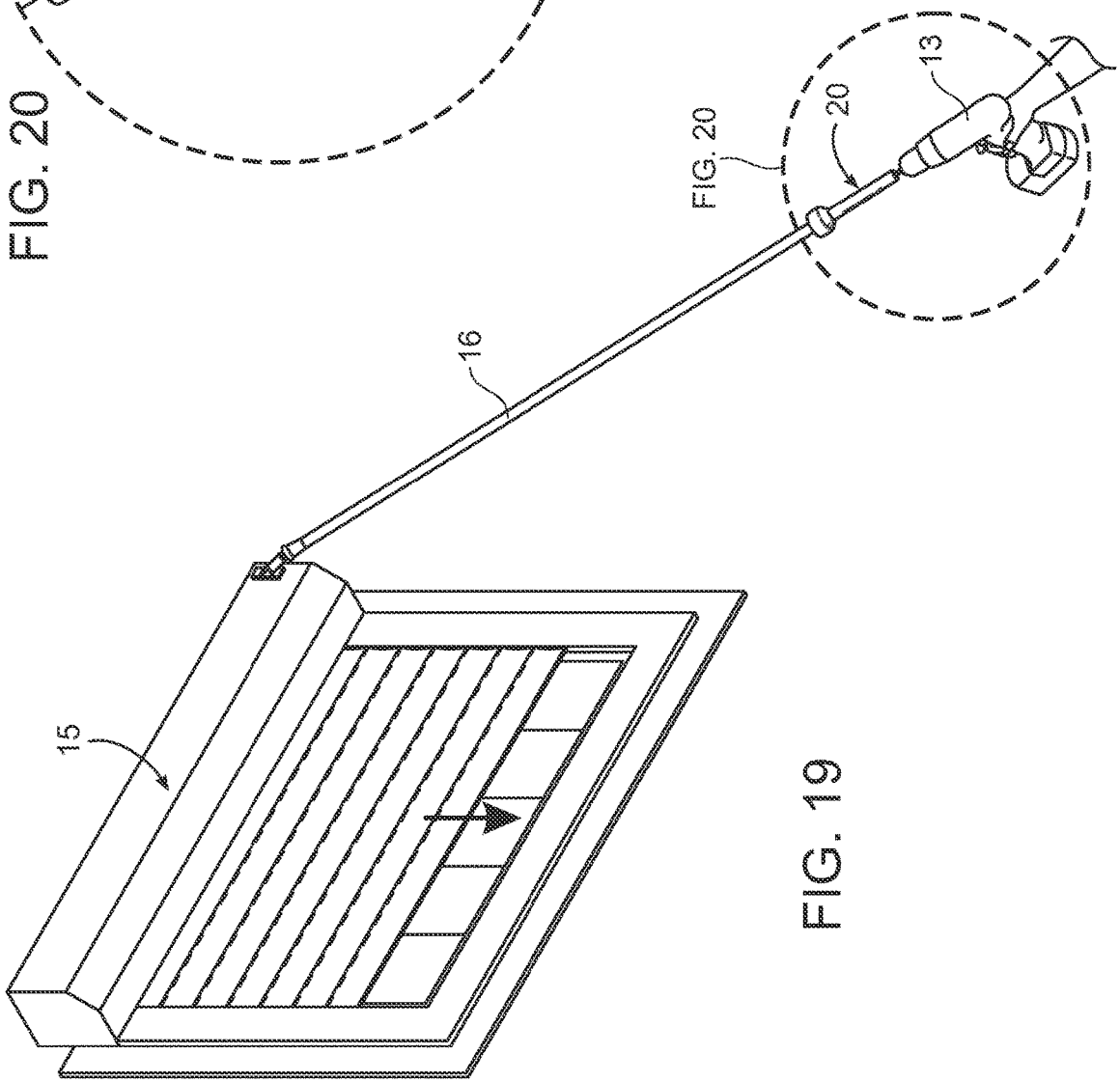
FIG. 19 is a perspective view of a shutter adjustment device in use to lower a shutter in accordance with an example embodiment.
Figure 22:
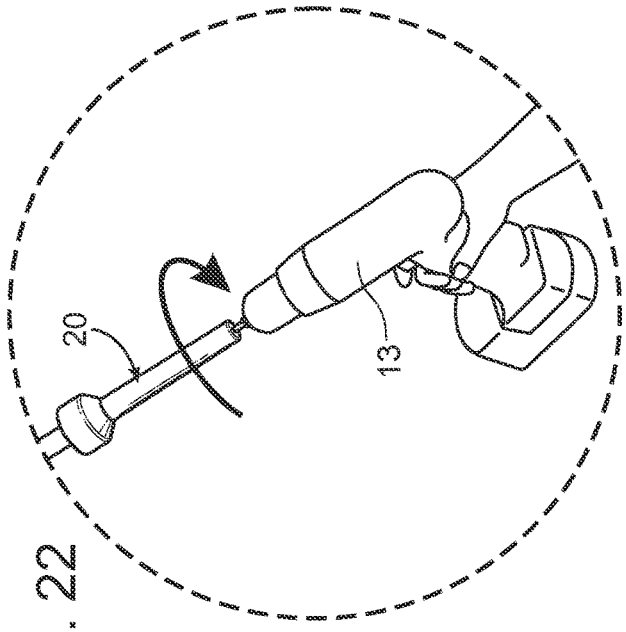
FIG. 22 is a close-up view from FIG. 21 of a shutter adjustment device in use in accordance with an example embodiment.
Figure 21:
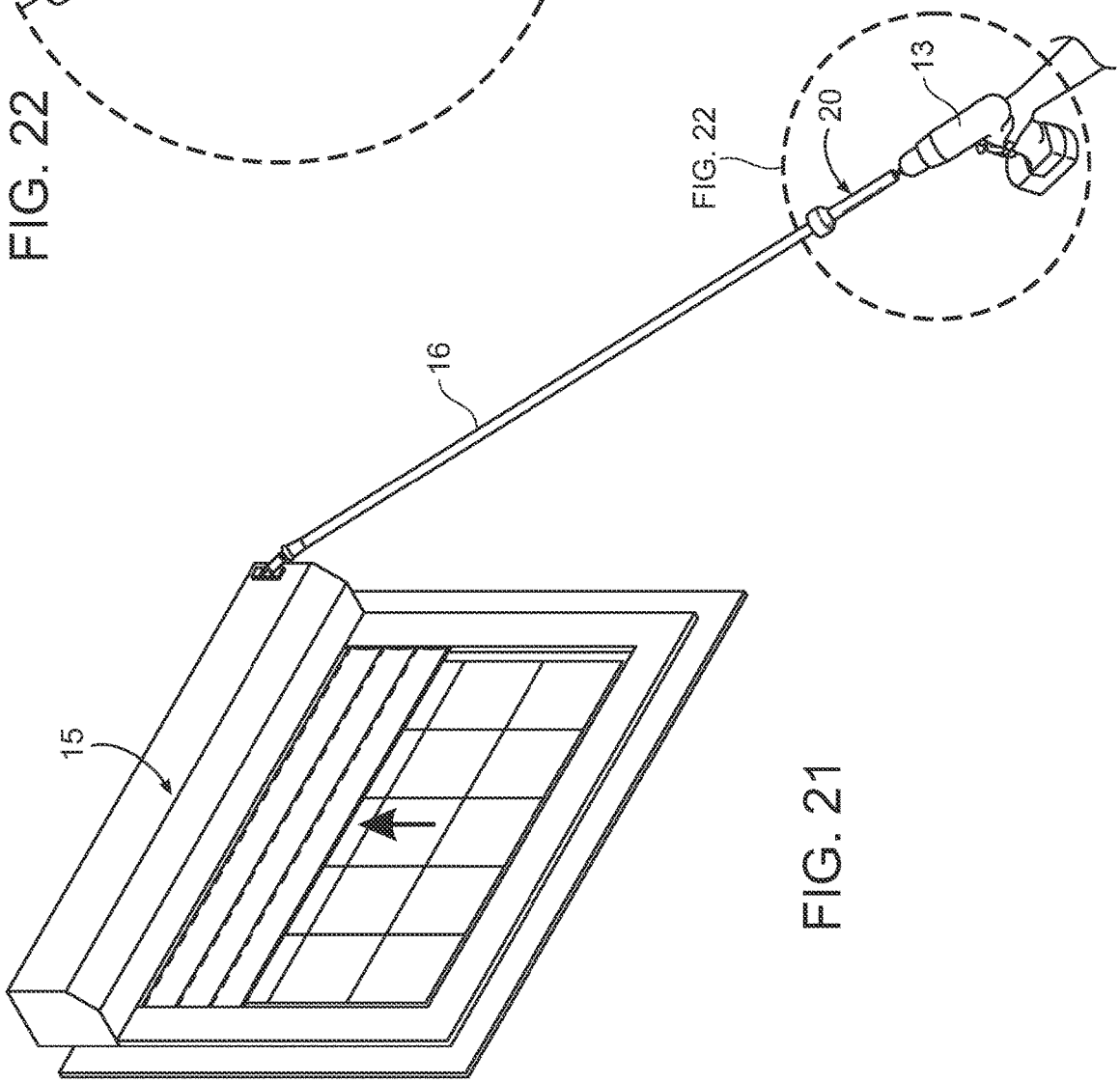
FIG. 21 is a perspective view of a shutter adjustment device in use to raise a shutter in accordance with an example embodiment.

FIGS. 9-11 illustrates a first exemplary embodiment of a clamp assembly 30 utilizing a circular base 31 from which a plurality of grips 32 extend. FIGS. 16 and 17 illustrate a second exemplary embodiment of a clamp assembly 30 utilizing a flexible linkage 37 such as a bungee cord or the like to which a plurality of grips 32 are connected. In the exemplary embodiment of FIG. 17, the bungee cord is threaded through each of the grips 32, with the elasticity of the bungee cord preventing the grips 32 from slipping out. Various other clamp assemblies 30 may be utilized, such as a chuck or the like.

The clamp assembly 30 is generally positioned within the cavity 28 of the receiver portion 24 of the housing 20 and accessible via the receiver opening 26 and, in embodiments including one, the slot 27. The clamp assembly 30 may be fixedly or removably connected within the housing 20. In the exemplary embodiments shown in the figures, the clamp assembly 30 may be removably connected around the supports 29*a*, 29*b*, 29*c*, 29*d* within the cavity 28 of the receiver portion 24 of the housing 20.

The clamp assembly 30 is shown as being biased into a closed position absent any force. The clamp assembly 30 is adapted to open up around the shutter lever 16 when the shutter lever 16 is inserted into the clamp assembly 30 while maintaining a strong frictional engagement with the shutter lever 16 such that it may be adjusted. When the shutter lever 16 is removed from the clamp assembly 30, the clamp assembly 30 is adapted to return to its original closed position.

In an exemplary embodiment shown in FIGS. 9 and 10, an exemplary clamp assembly 30 is illustrated as comprising a base 31 and a plurality of grips 32*a*, 32*b*, 32*c*, 32*d* extending from the base 31. Each of the grips 32*a*, 32*b*, 32*c*, 32*d* may comprise an elongated member such as an arm as shown in the figures. The grips 32*a*, 32*b*, 32*c*, 32*d* may include a notch or indentation as shown in FIG. 10 in which a hose clamp 33 may be engaged so as to bias the grips 32*a*, 32*b*, 32*c*, 32*d* toward a closed position.

The base 31 and grips 32*a*, 32*b*, 32*c*, 32*d* may comprise a range of materials. In the figures, the grips 32*a*, 32*b*, 32*c*, 32*d* are illustrated as comprising a flexible material such as plastic, rubber, or the like. The grips 32*a*, 32*b*, 32*c*, 32*d* may be arranged in a cross-shaped pattern, with the first grip 32*a* being positioned at a 0 degree position, the second grip 32*b* being positioned at a 90 degree position, the third grip 32*c* being positioned at a 180 degree position, and the fourth grip 32*d* being positioned at a 270 degree position.

Various other positioning of the grips 32*a*, 32*b*, 32*c*, 32*d* may be utilized. In the exemplary embodiment shown in the figures, the grips 32*a*, 32*b*, 32*c*, 32*d* are spaced-apart from each other to create gaps in which the supports 29*a*, 29*b*, 29*c*, 29*d* of the housing 20 may engage, with the grips 32*a*, 32*b*, 32*c*, 32*d* being positioned in the gaps between the supports 29*a*, 29*b*, 29*c*, 29*d*.

The grips 32*a*, 32*b*, 32*c*, 32*d* may be biased toward a closed position by various types of biasing members, such as utilizing springs, cords, anchors, brackets, or the like. In the exemplary embodiment shown in FIG. 5, the grips 32*a*, 32*b*, 32*c*, 32*d* are biased toward a closed position, in which the grips 32*a*, 32*b*, 32*c*, 32*d* are moved toward each other, by a hose clamp 33.

An exemplary embodiment of a hose clamp 33 is shown in FIG. 10 as comprising an O-ring 34 and a tightening member 38 for tightening or loosening the O-ring 34. As is typical with hose clamps 33, a screw 39 may extend through he tightening member 38 such that, when the screw 39 is rotated in a first direction, the O-ring 34 will tighten, and when the screw 39 is rotated in a second direction, the O-ring 34 will loosen. In this manner, the clamp assembly 30 may be adjusted to accommodate a wide range of different types of shutter levers 16 having different diameters or widths.

Another exemplary embodiment of a hose clamp 33 is illustrated in FIG. 16, in which a linkage 37 is shown as connecting the grips 32*a*, 32*b*, 32*c*, 32*d* in a circular arrangement. The linkage 37 may comprise an elongated member such as a cord or the like. The linkage 37 may comprise a bungee cord in an exemplary embodiment such as shown in FIG. 17.

The base 31 or linkage 37 may be positioned to engage around the grips 32*a*, 32*b*, 32*c*, 32*d* such as shown in FIGS. 4 and 5. The grips 32*a*, 32*b*, 32*c*, 32*d* may each include an indentation such as a notch as shown in FIG. 10 in which the base 31 or linkage 37 may engage around the grips 32*a*, 32*b*, 32*c*, 32*d*. With the base 31 or linkage 37 positioned around the grips 32*a*, 32*b*, 32*c*, 32*d*, the positioning of the grips 32*a*, 32*b*, 32*c*, 32*d* may be adjusted by utilizing the hose clamp 33.

D. Cover.

As best shown in FIGS. 1 and 2, a cover 40 may be selectively and removably connected around the housing 20. In the exemplary embodiment shown in the figures, the cover 40 may be positioned around the second end 22 of the housing 20 so as to cover the receiver opening 26 of the receiver portion 24. The cover 40 may be utilized to create a more aesthetic appearance for the housing 20 and to protect the clamp assembly 30 from dust or damage.

The cover 40 may comprise various materials and may be rigid or flexible. The cover 40 may frictionally engage over the receiver opening 26 of the receiver portion 24 of the housing 20 such as shown in FIG. 1. The cover 40 may comprise an outer end 41 which faces away from the housing 20 and an inner end 42 which is frictionally engaged around the housing 20 as shown in FIG. 2.

The outer end 41 of the cover 40 may comprise an opening 43 to provide access to the clamp assembly 30 as shown in FIG. 2. A shutter lever 16 may be inserted through the opening 43 of the cover 40 and into the receiver portion 24 of the housing 20 to be engaged by the clamp assembly 30. The cover 40 may be removed as needed to adjust the tightness of the clamp assembly 30 to accommodate different shutter levers 16.

E. Connector.

As best shown in FIGS. 11-16, the housing 20 may include a connector 50 which is adapted to removably connect the housing 20 to the drill 13 such that the housing 20 may be rotated by the drill 13. The connector 50 may be fixedly or removably connected to the housing 20. In some embodiments, the connector 50 may be integral with the housing 20.

The connector 50 may comprise an elongated member adapted to be removably secured within a drill chuck 14 in a manner which will allow the drill 13 to rotate the connector 50 and the housing 20 in both directions. The connector 50 may comprise various cross-sections, including a circular, square, triangular, or hexagonal cross-section such as shown in FIGS. 6-11.

Figure 12:
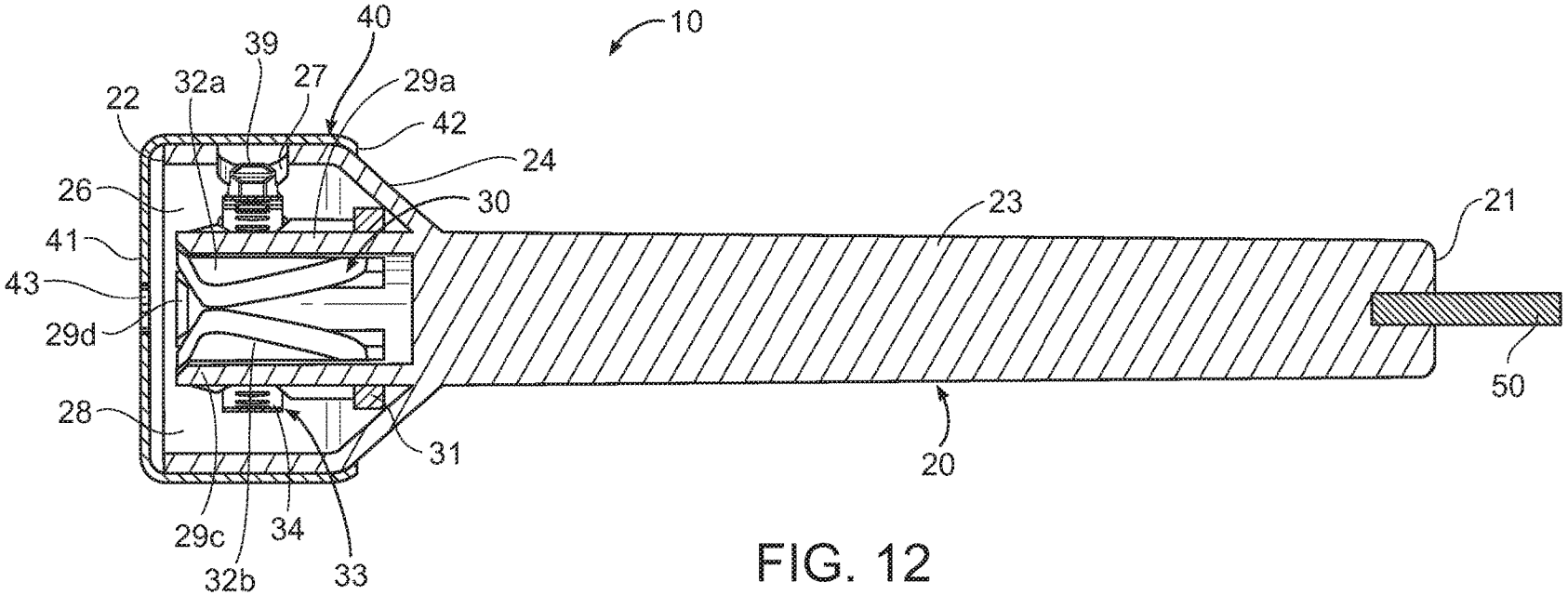
FIG. 12 is a side sectional view of a shutter adjustment device in accordance with an example embodiment.

The connector 50 will generally be connected to the first end 21 of the housing 20 such as shown in FIG. 12. The manner in which the connector 50 is connected to the housing 20 may vary in different embodiments. By way of example, the connector 50 could be connected to the housing 20 by frictional engagement, adhesives, fasteners, welding, or the like. In some embodiments, the connector 50 may be integrally formed with the housing 20.

Figure 13:
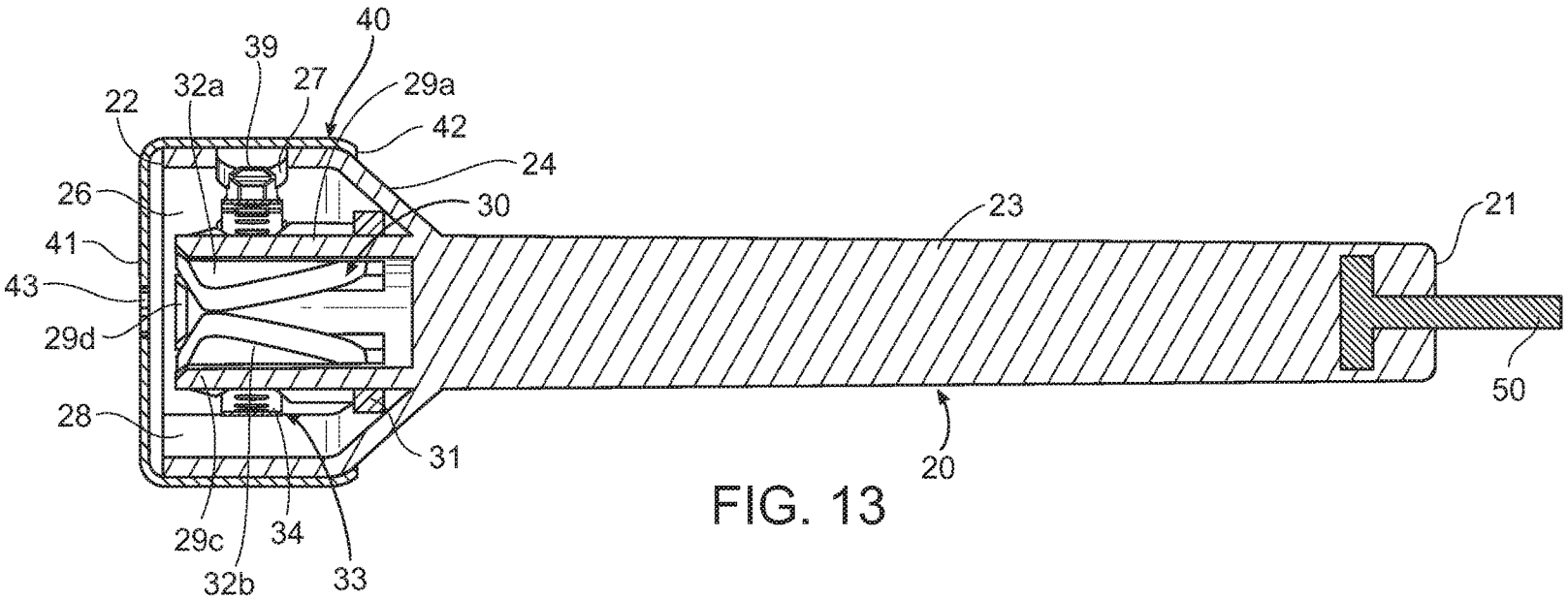
FIG. 13 is a side sectional view of a shutter adjustment device utilizing an alternate connector in accordance with an example embodiment.
Figure 14:
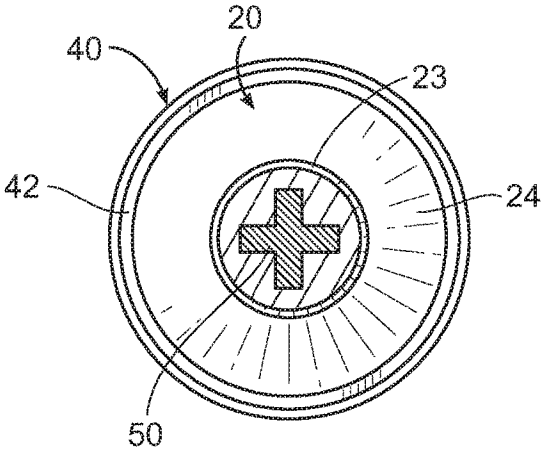
FIG. 14 is an end view of a shutter adjustment device utilizing a cross-shaped connector in accordance with an example embodiment.

The figures illustrate multiple exemplary embodiments of a connector 50 for use in connecting the housing 20 to a drill 13. FIG. 12 illustrates a linear, elongated connector 50 that may be removably connected within a connector opening 52 in the first end 21 of the housing 20. FIG. 13 illustrates T-shaped connector 50 which includes a pair of transverse portions at its end which aid with rotation of the housing 20 and securing the connector 50 within the housing 20. FIG. 14 illustrates yet another exemplary embodiment of a connector 50 which has a cross-shaped end that fits within the housing 20 for improved rotation and structural integrity.

Various other types of connectors 50 may be utilized so long as the connector 50 may be firmly connected within the housing 20 such that rotational force imparted to the connector 50 is simultaneously imparted to the housing 20 and, by extension, the shutter lever 16 secured within the clamp assembly 30 of the housing 20. Various types of drill bit connectors known in the art could be utilized, or any type of elongated member capable of being secured fastened within a drill chuck 14.

F. Operation of Preferred Embodiment.

In use, the shutter adjustment device 10 may be utilized as an adapter to interconnect a drill 13 with the shutter lever 16 of a shutter 15 such that the shutter 15 may be raised or lowered by the drill 13. The shutter adjustment device 10 may be connected between a drill 13 and a shutter lever 16 of a shutter 15 such that the drill 13 may rotate the shutter adjustment device 10, causing the shutter lever 16 to be similarly rotated to raise or lower the shutter 15.

Various types of drills 13 or tools known to impart rotational force may be utilized, including electric drills, gas-powered drills, hydraulic drills, both corded and wireless drills, and the like. The drill 13 will preferably be adapted to rotate in both directions so that the shutter 15 may be both raised and lowered by the shutter adjustment device 10.

To initially set up the shutter adjustment device 10, the clamp assembly 30 may need to be adjusted to fit the size of the shutter lever 16 of the shutter 15 being used. It may also be necessary to adjust the clamp assembly 30 between raising or lowering different shutters 15 if different types of shutters 15 having differently-sized shutter levers 16 are in use in the same building. The clamp assembly 30 may be adjusted by utilizing the hose clamp 33 to tighten or loosen the O-ring 34 which is connected around the grips 32*a*, 32*b*, 32*c*, 32*d*.

As the O-ring 34 is tightened, the grips 32*a*, 32*b*, 32*c*, 32*d* will be drawn toward each other, effectively decreasing the effective width of the opening between the grips 32*a*, 32*b*, 32*c*, 32*d* in which the shutter lever 16 is inserted. As the O-ring 34 is loosened, the grips 32*a*, 32*b*, 32*c*, 32*d* will resiliently move outward due to the absence of force against them, effectively increasing the effective width of the opening between the grips 32*a*, 32*b*, 32*c*, 32*d* in which the shutter lever 16 is inserted.

To adjust the tightness of the clamp assembly 30, a tool 18 such as a screwdriver may be inserted through the cavity 28 of the housing 20 to engage with the screw 39 of the tightening member 38 of the hose clamp 33 such as shown in FIG. 4. Rotation of the tool 18 in a first direction will tighten the hose clamp 33 and rotation of the tool 18 in a second direction will loosen the hose clamp 33.

The hose clamp 33 should be tightened so that it is slightly smaller in diameter than the shutter lever 16 being engaged by the shutter adjustment device 10. When the shutter lever 16 is inserted into the housing 20, the grips 32*a*, 32*b*, 32*c*, 32*d* will be open up and be forced against the O-ring 34, which will secure the shutter lever 16 within the hose clamp 33.

The cover 40, if used, may be removed prior to adjusting the hose clamp 33 such as shown in FIG. 4 and then placed back in position so as to cover the receiver opening 26 of the receiver portion 24 of the housing 20 such as shown in FIG. 1.

Prior to engaging with the shutter lever 16, the shutter adjustment device 10 should first be connected to a drill 13. The connector 50, if not already connected, may be connected to the housing 20 by inserted within the connector opening 52 on the first end 21 of the housing 20. The distal end of the connector 50 may then be inserted into a drill chuck 14 of a drill 13 and the drill chuck 14 may be tightened to secure around the connector 50.

With the shutter adjustment device 10 connected to the drill 13, it is ready for use. An individual may walk over to the shutter 15 and, holding the drill 13 in his or her hand, position the drill 13 such that the shutter lever 16 is inserted into the housing 20 to be engaged by the clamp assembly 30. The shutter lever 16 may be inserted through the opening 43 of the cover 40 if the cover 40 is installed, or directly through the receiver opening 26 of the receiver portion 24 of the housing 20 if no cover 40 is being used.

As the shutter lever 16 passes into the clamp assembly 30, it will force the grips 32*a*, 32*b*, 32*c*, 32*d* outwardly. The grips 32*a*, 32*b*, 32*c*, 32*d* will be pressed against the 0-ring 34 and thus be secured around the shutter lever 16 such as shown in FIG. 15. With the shutter lever 16 secured within the clamp assembly 30, the drill 13 may be activated.

The drill 13 will rotate the connector 50, the housing 20, and the shutter lever 16 secured within the clamp assembly 30 of the housing 20. In this manner, the shutter 15 may be raised or lowered by rotating the drill 13 in a first or second direction such as shown in FIGS. 19-22. When finished, the housing 20 may be removed from around the shutter lever 16 by grasping the housing 20 or the drill 13 and firmly pulling backward, which will slide the shutter lever 16 out from between he grips 32*a*, 32*b*, 32*c*, 32*d*. The grips 32*a*, 32*b*, 32*c*, 32*d* will then resiliently return to their original, closed position, awaiting insertion of a new shutter lever 16.

Unless otherwise defined, all technical and scientific terms used herein have the same meaning as commonly understood by one of ordinary skill in the art to which this invention belongs. Although methods and materials similar to or equivalent to those described herein can be used in the practice or testing of the shutter adjustment device, suitable methods and materials are described above. All publications, patent applications, patents, and other references mentioned herein are incorporated by reference in their entirety to the extent allowed by applicable law and regulations. The shutter adjustment device may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A shutter adjustment device, comprising:

a housing including a first end and a second end, wherein the housing comprises a plurality of supports within the cavity;

a receiver opening in the second end of the housing, the receiver opening providing access to a cavity formed in the second end of the housing; and a clamp assembly connected within the cavity of the housing, the clamp assembly being adapted to removably engage with a shutter lever of a shutter when the shutter lever is inserted within the receiver opening of the housing, wherein the clamp assembly is connected to the plurality of supports, wherein the clamp assembly comprises a base and a plurality of grips which extend from the base;

wherein the housing is adapted to be removably connected to a drill such that the housing may be rotated by the drill to raise or lower the shutter when the shutter lever is secured within the clamp assembly.

2. The shutter adjustment device of claim 1, wherein the housing comprises a handle portion and a receiver portion, wherein the handle portion is elongated, wherein the receiver portion is wider than the handle portion.

3. The shutter adjustment device of claim 1, wherein the base of the clamp assembly is secured around the plurality of supports by a hose clamp.

4. The shutter adjustment device of claim 1, wherein the clamp assembly comprises a hose clamp for biasing the plurality of grips into a closed position.

5. The shutter adjustment device of claim 4, wherein the clamp assembly comprises a tightening member for tightening or loosening the hose clamp.

6. The shutter adjustment device of claim 5, wherein the housing comprises a slot positioned over the tightening member such that a screwdriver may be inserted through the slot to adjust the tightening member.

7. The shutter adjustment device of claim 6, wherein the housing comprises a lip against which the tightening member of the clamp assembly is secured.

8. The shutter adjustment device of claim 1, comprising a connector extending from the first end of the housing to connect to the drill.

9. The shutter adjustment device of claim 8, wherein the connector comprises a T-shape.

10. The shutter adjustment device of claim 1, comprising a cover removably connected over the receiver opening of the housing.

11. A shutter adjustment device, comprising:

a housing including a first end and a second end, wherein the housing comprises a receiver portion and a handle portion, wherein the handle portion is elongated;

a receiver opening in the receiver portion of the housing, the receiver opening providing access to a cavity formed in the receiver portion of the housing;

a clamp assembly connected within the cavity of the receiver portion of the housing, the clamp assembly being adapted to removably engage with a shutter lever of a shutter when the shutter lever is inserted within the receiver opening of the housing; and a connector extending from the first end of the housing, the connector being adapted to removably connect a drill to the housing such that the housing may be rotated by the drill, wherein the housing is adapted to be rotated by the drill to raise or lower the shutter when the shutter lever is secured within the clamp assembly;

wherein the clamp assembly comprises a plurality of grips, the plurality of grips being adapted to removably engage with the shutter lever, wherein the plurality of grips are biased toward a closed position.

12. The shutter adjustment device of claim 11, wherein the clamp assembly comprises a hose clamp connected around the plurality of grips to bias the plurality of grips toward the closed position.

13. The shutter adjustment device of claim 12, wherein the clamp assembly comprises a base, wherein the plurality of grips extend from the base.

14. The shutter adjustment device of claim 13, wherein the base comprises a cord.

15. The shutter adjustment device of claim 13, wherein the housing comprises a plurality of supports within the cavity of the housing, wherein the base of the clamp assembly is connected around the plurality of supports.

16. A shutter adjustment device, comprising:

a housing including a first end and a second end;

a receiver opening in the second end of the housing, the receiver opening providing access to a cavity formed in the second end of the housing; and a clamp assembly connected within the cavity of the housing, the clamp assembly being adapted to removably engage with a shutter lever of a shutter when the shutter lever is inserted within the receiver opening of the housing, wherein the clamp assembly comprises a plurality of grips, wherein the clamp assembly comprises a hose clamp for biasing the plurality of grips into a closed position;

wherein the housing is adapted to be removably connected to a drill such that the housing may be rotated by the drill to raise or lower the shutter when the shutter lever is secured within the clamp assembly.

17. The shutter adjustment device of claim 16, wherein the clamp assembly comprises a tightening member for tightening or loosening the hose clamp.

18. The shutter adjustment device of claim 17, wherein the housing comprises a slot positioned over the tightening member such that a screwdriver may be inserted through the slot to adjust the tightening member.

19. The shutter adjustment device of claim 18, wherein the housing comprises a lip against which the tightening member of the clamp assembly is secured.

* * * * *